US005275271A

United States Patent [19]

Endo et al.

[11] Patent Number: 5,275,271

[45] Date of Patent: Jan. 4, 1994

[54] FEEDING/STORING APPARATUS FOR ROD-SHAPED ARTICLES

[75] Inventors: Isao Endo, Chiba; Shinichi Arima, Tokyo; Kunihiro Konishi, Chiba; Shinji Tanaka, Tokyo, all of Japan

[73] Assignees: Tokyo Automatic Machinery Works, Ltd.; Japan Tobacco Inc., Tokyo, Japan

[21] Appl. No.: 18,716

[22] Filed: Feb. 17, 1993

[30] Foreign Application Priority Data

Feb. 26, 1992 [JP] Japan ..... 4-039600

[51] Int. Cl.[5] ..... B65G 37/00

[52] U.S. Cl. ..... 198/347.3

[58] Field of Search ..... 198/347.3, 778

[56] References Cited

U.S. PATENT DOCUMENTS

| | | | |
|---|---|---|---|
| 4,042,094 | 8/1977 | Schmermund . | |
| 4,099,608 | 7/1978 | McCombie | 198/347.3 |
| 4,254,858 | 3/1981 | Seragnoli | 198/347.3 |
| 4,344,445 | 8/1982 | Seragnoli | 198/347.3 X |
| 4,429,779 | 2/1984 | Hinchcliffe | 198/347.3 |
| 4,653,631 | 3/1987 | Heybourn et al. | 198/347.3 X |
| 4,869,115 | 3/1975 | Barkley | 198/347.3 X |
| 4,872,543 | 10/1989 | Hinchcliffe | 198/347.3 |
| 4,986,718 | 1/1991 | Kumata et al. . | |

FOREIGN PATENT DOCUMENTS

| | | |
|---|---|---|
| 56-102782 | 8/1981 | Japan . |
| 59-162867 | 9/1984 | Japan . |
| 59-46588 | 11/1984 | Japan . |
| 4-200376 | 7/1992 | Japan . |
| 995663 | 6/1965 | United Kingdom . |
| 2065057 | 6/1981 | United Kingdom . |
| 2104030 | 3/1983 | United Kingdom . |
| 2135951 | 9/1984 | United Kingdom . |

*Primary Examiner*—D. Glenn Dayoan

*Attorney, Agent, or Firm*—Sandler Greenblum & Bernstein

[57] ABSTRACT

A circular-arc shaped movable conveyor is horizontally turned along a circular-arc orbital path of a stationary conveyor according to the difference between he feeding-in amount from feeding-in port to the movable conveyor and the feeding-out amount from the stationary conveyor to a feeding-out port. Thus, the capacities of an upper compartment on the movable conveyor and a lower compartment on the stationary conveyor are increased and decreased,so that the imbalance between the demand to a post-processing machine and the supply from a pre-processing machine can be adjusted. Furthermore, the rod-shaped articles are fed from he feeding-in port to the feeding-out port while sequentially passing through the upper compartment and the lower compartment.

10 Claims, 5 Drawing Sheets

FEEDING/STORING APPARATUS FOR ROD-SHAPED ARTICLES

BACKGROUND OF THE INVENTION

1. Field of the Invention

The present invention is generally directed to a feeding/storing apparatus for rods or rod-shaped articles, such as filter-cigarettes, filterless cigarettes, or filter-plugs. The apparatus is provided in a process for feeding built-up rods in order by conveyors from a pre-processing machine, such as a cigarette fabricating machine, to a post-processing machine, such as a packaging machine. More specifically, the present invention is directed to a feeding/storing apparatus including a stationary conveyor communicating with a feeding-out port which is provided under a horizontally movable conveyor, which communicates with a feeding-in port in parallel relation thereto. A turning passage is movable with the movable conveyor, which is formed over the distance from the leading edge of an upper compartment, which is defined on the movable conveyor, to the end of a lower compartment, which is defined on the stationary conveyor. The capacities of the upper compartment and the lower compartment are increased and decreased by horizontal movement of the movable conveyor according to the difference between a feeding-in amount from the feeding-in port to the movable conveyor and feeding-out amount from the stationary conveyor to the feeding-out port.

2. Description of Background

A conventional feeding/storing apparatus for rods of this type is disclosed in, for example, Japanese Patent Publication No. SHO 59-46558. In this apparatus, a movable conveyor and a stationary conveyor are linearly formed. Cigarettes which are built-up by the movable conveyor are horizontally press-fed from the leading edge of an upper compartment to a guide plate, while abutting each other in the feeding direction. The cigarettes are then turned downwardly along a turning passage and fed to the end of a lower compartment. With this construction, when the cigarette fabricating machine, as a pre-processing machine, is stopped because of a failure or the like, the movable conveyor is stopped. When the built-up amount of the cigarettes at the feeding-out port is more than a specified height, the stationary conveyor is stopped. Furthermore, when the stationary conveyor is stopped and only the movable conveyor is operated, the movable conveyor is linearly moved in the direction of increasing the capacities of the upper compartment defined on the movable conveyor and the lower compartment defined on the stationary conveyor, thereby increasing the stored amount. When the stored amount thus reaches the maximum, the cigarette fabricating machine is stopped. Also, when the movable conveyor is stopped and only the stationary conveyor is operated, the movable conveyor is linearly moved in the direction of reducing the capacities of the upper compartment and the lower compartment, thereby reducing the stored amount. When the stored amount thus reaches the minimum, a packaging machine, as a post-processing machine, is stopped.

Also, as disclosed in Japanese Laid-Open Patent No. SHO 59-162867, a storage conveyor is branched from the midway of a feeding conveyor for directly supplying cigarettes from a cigarette fabricating machine, as a pre-processing machine, to a packaging machine, as a post-processing machine. With this construction, when the supplied amount from the cigarette fabricating machine to the packaging machine is excessive, the cigarettes are fed to the storage conveyor from the feeding conveyor and thus stored. In absence of cigarettes, those stored on the storage conveyor are supplied to the feeding conveyor.

However, the conventional feeding/storing apparatus for rods have the following disadvantages. In the first described apparatus, the stored amount is increased and decreased by linear movement of the movable conveyor over the stationary conveyor. Accordingly, to further increase the stored amount, the lengths of the movable and stationary conveyors must be further enlarged in the longitudinal direction. In particular, in the case when the feeding/storing apparatus are laterally aligned between the cigarette fabricating machine, as the pre-processing machine, and the packaging machine, as the post-processing machine, both machines must be separated from each other by the extent required for increasing the stored amount. This presents the problem of enlarging the size of the entire apparatus.

Furthermore, in the case when the rods are filter cigarettes, the first apparatus is inconvenient. The outside of the filter is slightly larger than that of the cigarette. Accordingly, when the cigarettes are stacked in multi-levels on the linear conveyor, the filter side portions thereof abut each other and are thus firmly built-up; however, the opposite leading edge side portions thereof are built-up so that horizontal gaps are formed between the cigarettes. Consequently, the leading edges of the cigarettes are liable to slip due to vibrations caused during the feeding operation, thereby degrading the quality of the cigarettes, such as by damage to the cigarettes or loss of tobacco.

Also, the second apparatus is disadvantageous, since the cigarettes which are first fed on the storage conveyor are fed out last therefrom. Accordingly, the first stored cigarettes are stored for a long time in the storage conveyor, thereby significantly degrading the quality of the cigarettes.

To solve the above problems, the following technique has been proposed. The movable conveyor and the stationary conveyor are respectively formed in circular-arc shapes. The circular-arc shaped movable conveyor is horizontally turned along the circular-arc orbital path of the stationary conveyor according to the difference between the feeding-in amount from the feeding-in port to the movable conveyor and the feeding-out amount from the stationary conveyor to the feeding-out port. This makes it possible to increase and decrease the capacities of the upper compartment defined on the movable conveyor and the lower compartment defined on the stationary conveyor. Thus, the imbalance between the demand to the post-processing machine and the supply from the pre-processing machine can be adjusted. Also, the rods carried from the feeding-in port can be fed to the feeding-out port while sequentially passing through the upper compartment and the lower compartment.

The above-described apparatus, however,has the following disadvantage. Since the rods which are built-up on the movable and stationary conveyors, respectively, are formed in circular-arc shapes, sector-shaped gaps are respectively formed in the feeding direction. Accordingly, for example, when the rods are linearly press-fed from the leading edge of the movable conveyor in the feeding direction to the guide plate while abutting each other, the sector-shaped gaps between the rods are compressed and the rods are crushed in the feeding direction, and simultaneously, are pushed while abutting each other over the whole axial length thereof. Thus, the rods are liable to axially slip toward the low pressure sides in which the sector-shaped gaps are larger. This brings about not only disorder of the rods, but also the obstruction of the group of rods from being linearly press-fed at high efficiency.

To solve the above problem, there has been proposed a technique of erecting a disorder preventing plate opposite to the axial end surfaces of the rods over the distance from the leading edge of the movable conveyor in the feeding direction to the guide plate. However, this technique is disadvantageous in that the end surfaces of the rods contact the disorder preventing plate, so that the rods are horizontally turned by friction, thereby causing irregularity in the attitudes of such rods.

SUMMARY OF THE INVENTION

Taking the above circumstances into consideration, the present invention has been developed. An object of the present invention is to first feed the rods which are first stored while increasing the stored amount without significantly lengthening a movable conveyor and a stationary conveyor in the direction between a pre-processing machine and a post-processing machine.

Another object of the present invention is to push the rods from the movable conveyor to the stationary conveyor while maintaining the alignment of the rods. A further object of the present invention is to push the rods from the stationary conveyor to a feeding-out port while maintaining the alignment of the rods.

A still further object of the present invention is to firmly build-up filter-cigarettes, as the rods, by horizontally abutting the filter side portions on the opposed leading edge side portions.

To solve the above problems, according to the present invention, there is provided an arrangement wherein a movable conveyor and a stationary conveyor are respectively formed in circular-arc shapes having the same curvature. The center of the circular-arc of the stationary conveyor is arranged directly under that of the movable conveyor. The movable conveyor is horizontally turnable, and the feeding surfaces of the movable and stationary conveyors are oppositely movable in the circular-arc directions with respect to each other.

Preferably, a guide plate may be located separately from the leading edge of the movable conveyor in the feeding direction; a linear part is located at the leading edge of the movable conveyor in the feeding direction so as to be transverse to the guide plate at right angles; and the lower portion of the guide plate is inclined downwardly with respect to the feeding direction of the stationary conveyor by the horizontal length of the linear part.

Furthermore, a linear part may be located at the leading edge of the stationary conveyor in the feeding direction so as to be directed toward the feeding-out port.

Also, when the rods are filter cigarettes, the cigarettes may be fed in such a manner that the filter side portions of the cigarettes are directed to the outer peripheral sides of the movable conveyor and the stationary conveyor.

According to the present invention, the circular-arc shaped movable conveyor is horizontally turned along the circular-arc orbital path of the stationary conveyor according to the difference between the feeding-in amount from the feeding-in port to the movable conveyor and the feeding-out amount from the stationary conveyor to the feeding-out port. This makes it possible to increase and decrease the capacities of the upper compartment defined on the movable conveyor and the lower compartment defined on the stationary conveyor. Thus, the imbalance between the demand to the post-processing machine and the supply from the pre-processing machine can be adjusted. Also, the rods fed from the feeding-in port can be fed to the feeding-out port while sequentially passing through the upper compartment and the lower compartment.

The rods fed on the movable conveyor from the feeding-in port are fed in a circular-arc direction by the movable conveyor, and are then linearly fed at the linear part while being transverse to the guide plate. Thus, the rods are parallel to each other and the sector-shaped gaps therebetween are eliminated. The rods are horizontally pushed from the leading edge of the upper compartment to the guide plate.

Furthermore, after being fed in the circular-arc direction by the stationary conveyor, the rods are linearly fed to the feeding-out port at the linear part. Thus, the rods are parallel to each other since the sector-shaped gaps between the rods are eliminated, and the rods are horizontally pushed from the leading edge of the lower compartment to the feeding-out port.

Also, the cigarettes are fed in such manner that the filter side portions are directed to the outer peripheral sides of the circular-arc shaped movable and stationary conveyors. Accordingly, the cigarettes are stacked radially around the circular-arc center of the movable and stationary conveyors, respectively.

According to one aspect of the invention, a feeding/storing apparatus for rod-shaped articles includes a stationary conveyor communicating with a feeding-out port, and a horizontally movable conveyor being provided over the stationary conveyor and communicating with a feeding-in port. The stationary conveyor and the movable conveyor are in parallel and spaced relation with each other. A turning passage is movable with the movable conveyor, the turning passage being formed over the distance from the leading edge of an upper compartment defined on the movable conveyor to the end of a lower compartment defined on the stationary conveyor.

The capacities of the upper compartment and the lower compartment are increased and decreased by horizontal movement of the movable conveyor according to the difference between a feeding-in amount from the feeding-in port to the movable conveyor and a feeding-out amount from the stationary conveyor to the feeding-out port. The movable conveyor and the stationary conveyor are respectively formed in circular-arc shapes having the same curvature, the center of the circular-arc of the stationary conveyor being arranged directly under the center of the circular-arc of the movable conveyor; the movable conveyor being horizontally turnable; and supporting surfaces of the movable conveyor and the stationary conveyor being moved in the opposite circular-arc directions to each other.

A guide plate is positioned separately from the leading edge of the movable conveyor in the feeding direction, and a linear part is positioned at a leading edge of the movable conveyor in the feeding direction in such a manner as to be transverse to the guide plate at right angles. A lower portion of the guide plate is inclined downwardly with respect to the feeding direction of the stationary conveyor by the horizontal length of the linear part. A linear part is positioned at a leading edge of the stationary conveyor in the feeding direction so as to be directed toward the feeding-out port.

According to another aspect of the invention, the rod-shaped articles comprise filter cigarettes, the cigarettes being fed in such a manner that the filter side portions thereof are directed to outer peripheral sides of the movable conveyor and the stationary conveyor.

According to another aspect of the claimed invention, the feeding/storing apparatus for rod-shaped articles includes a stationary conveyor, and a horizontally movable conveyor being provided over the stationary conveyor. The stationary conveyor and the movable conveyor are in parallel and spaced relation with each other. A turning passage is movable with the movable conveyor, the turning passage communicating with an upper compartment defined on the movable conveyor and a lower compartment defined on the stationary conveyor. The capacities of the upper compartment and the lower compartment are increased and decreased by horizontal movement of the movable conveyor according to the difference between a feeding-in amount from the feeding-in port to the movable conveyor and a feeding-out amount from the stationary conveyor to the feeding-out port.

The movable conveyor and the stationary conveyor are respectively formed in circular-arc shapes having the same curvature, the center of the circular-arc of the stationary conveyor being arranged directly under the center of the circular-arc of the movable conveyor. The movable conveyor is horizontally turnable, and supporting surfaces of the movable conveyor and the stationary conveyor are moved in the opposite circular-arc directions to each other. A guide plate is positioned adjacent a leading edge of the movable conveyor in the feeding direction, and a linear part is positioned at a leading edge of the movable conveyor in the feeding direction in such a manner as to be transverse to the guide plate at right angles. A lower portion of the guide plate is inclined downwardly with respect to the feeding direction of the stationary conveyor by the horizontal length of the linear part. A linear part is positioned at a leading edge of the stationary conveyor in the feeding direction so as to be directed toward the feeding-out port.

According to another aspect of the invention, a method for feeding/storing rod-shaped articles, includes the steps of: providing a stationary conveyor for communicating with a feeding-out port which is provided under a horizontally movable conveyor and communicating with a feeding-in port; providing a turning passage movable with the movable conveyor, the turning passage being formed over the distance from the leading edge of an upper compartment defined on the movable conveyor to the end of a lower compartment defined on the stationary conveyor; changing the capacities of the upper compartment and the lower compartment by horizontally moving the movable conveyor according to the difference between a feeding-in amount from the feeding-in port to the movable conveyor and a feeding-out amount from the stationary conveyor to the feeding-out port; forming the movable conveyor and the stationary conveyor are respectively in circular-arc shapes having the same curvature, the center of the circular-arc of the stationary conveyor being arranged directly under the center of the circular-arc of the movable conveyor; and horizontally turning the movable conveyor, thereby moving the supporting surfaces of the movable conveyor and the stationary conveyor in the opposite circular-arc directions to each other.

When the rod-shaped articles are filter cigarettes, the method also includes feeding the cigarettes in such a manner that the filter side portions thereof are directed to outer peripheral sides of the movable conveyor and the stationary conveyor.

BRIEF DESCRIPTION OF THE DRAWINGS

The invention is further explained in the description which follows with reference to the drawings illustrating, by way of non-limiting examples, embodiments of the invention wherein.

DETAILED DESCRIPTION OF THE PREFERRED EMBODIMENTS

Figure 1:
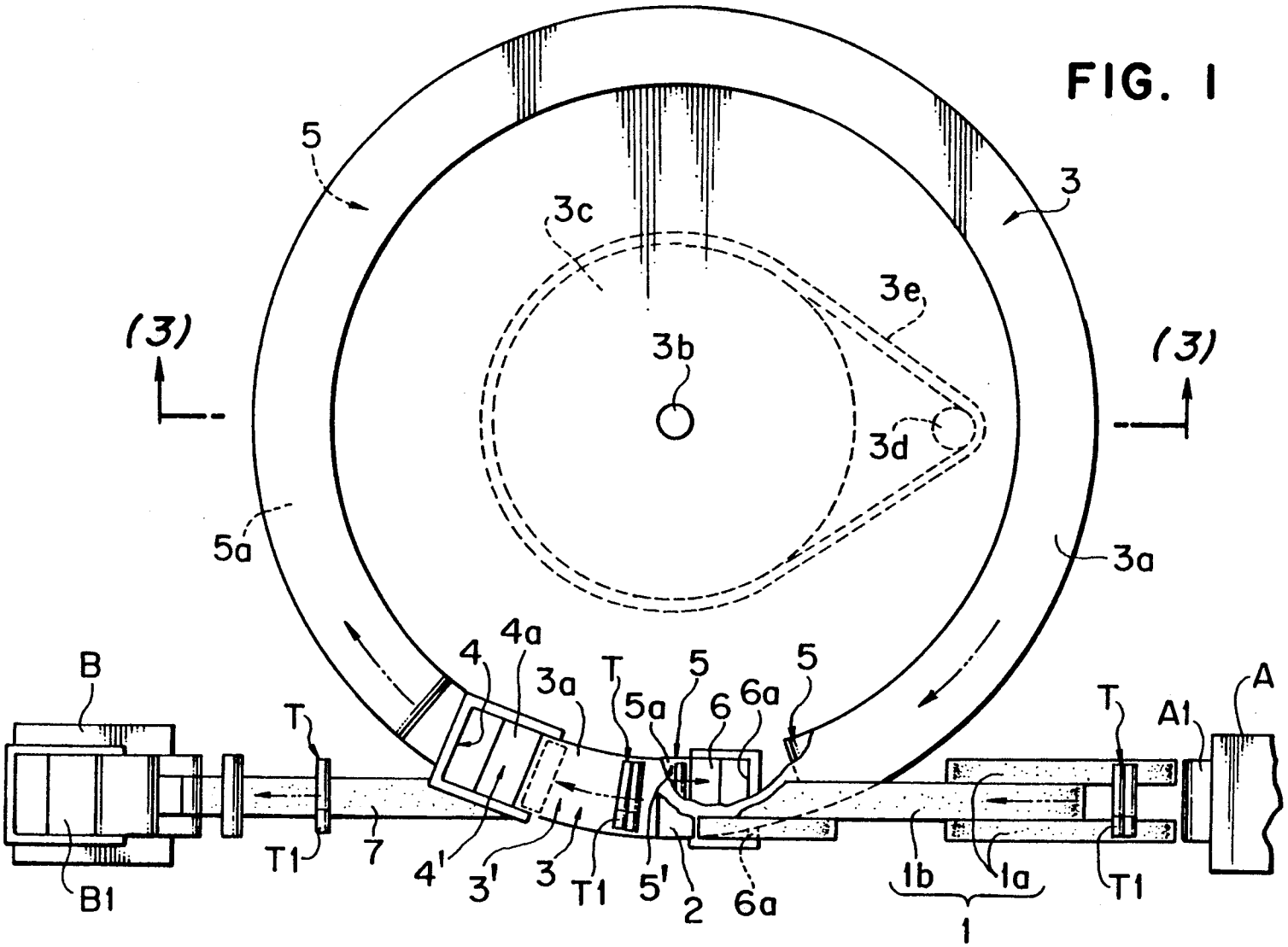
FIG. 1 is a plan view, partially broken away, of a feeding/storing apparatus for rod-shaped articles according to one embodiment of the present invention.
Figure 2:
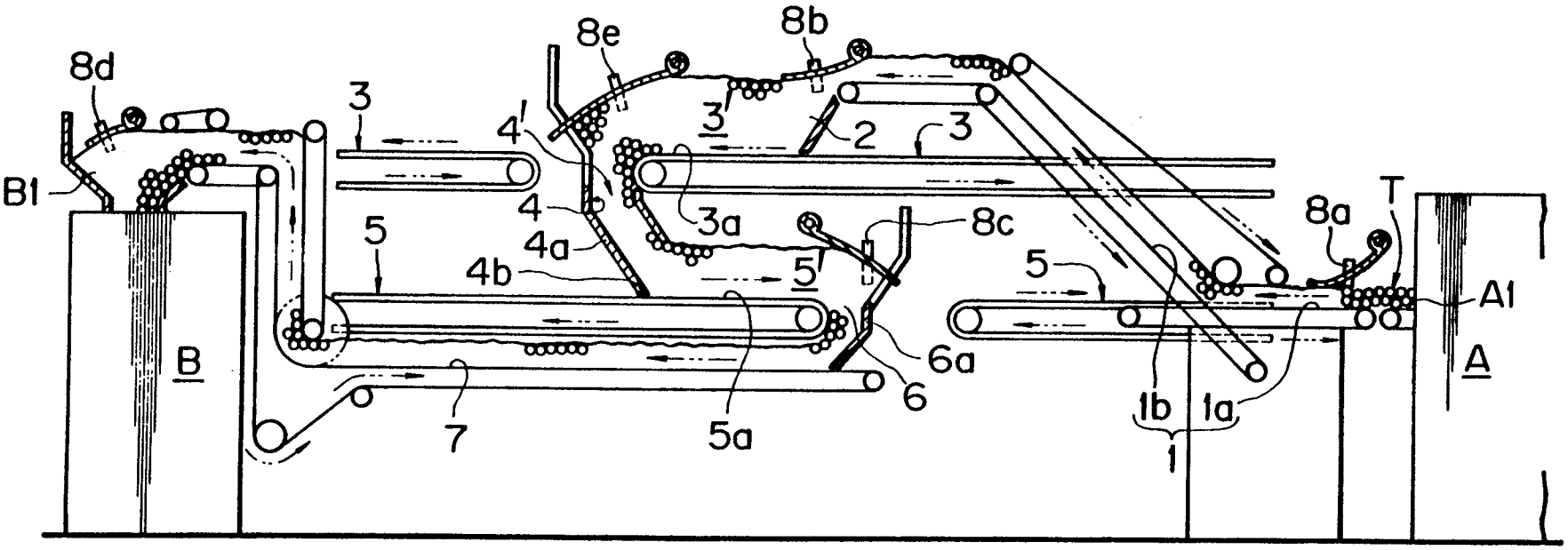
FIG. 2 is a vertical sectional front view of the embodiment of FIG. 1.
Figure 3:
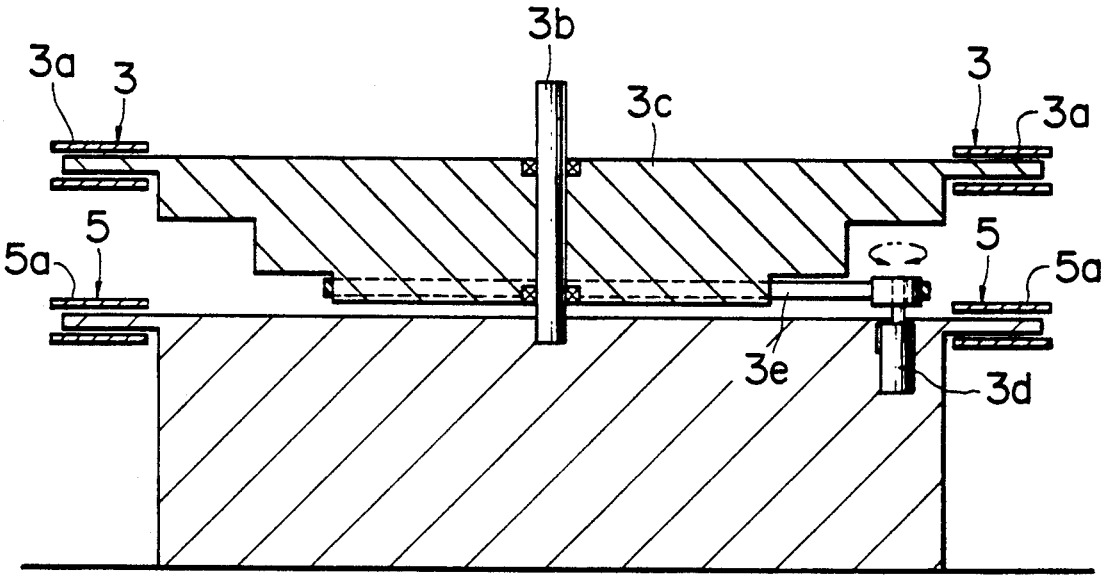
FIG. 3 is a vertical sectional view taken on the line (3)—(3) of FIG. 1.

FIGS. 1 and 2 illustrate one embodiment of the present invention. The rods are illustrated as filter cigarettes T. A feeding-in conveyor 1 includes a horizontal part 1*a* and an inclined part 1*b* and extends from an outlet A1 of a cigarette fabricating machine A, as a pre-processing machine, to a feeding-in port 2 provided over a movable conveyor 3. The feeding-in conveyor 1 feeds a group of cigarettes T from outlet A1 to feeding-in port 2 in such a manner that the filter side portions T1 are directed to the outer periphery sides of movable conveyor 3 and stationary conveyor 5. A feeding-out port 6 is formed between the leading edge of stationary conveyor 5 in the feeding direction and guide 6*a* which is separated from stationary conveyor 5. Furthermore, feeding-out conveyor 7 extends from the feeding-out port 6 to inlet B1 of packaging machine B, as a post-processing machine. Thus, feeding-out conveyor 7 caries the group of cigarettes T from the feeding-out port 6 to inlet B1 of packaging machine B.

Movable conveyor 3 and stationary conveyor 5 are formed by using a chain-conveyor such as disclosed in Japanese Patent Laid-Open No. 4-200376 (Japanese Patent Application No. 2-334605). In the chain-conveyor, the feeding surface can be freely curved in vertical and horizontal directions transverse to the feeding direction. Thus, the flat surfaces of both conveyors 3 and 5 are respectively formed in circular-arc shapes having the same curvature. Also, center shaft 3*b* extends upwardly at the center of stationary conveyor 5, and the center of movable conveyor 3 is horizontally pivotally supported by center shaft 3*b*. The circular-arc center of stationary conveyor 5 is disposed directly under the center of movable conveyor 3. Thus, supporting surface 3*a* of movable conveyor 3 can be moved in a circular-arc direction which is continuous with the feeding direction of feeding-in conveyor and supporting surface 5a of stationary conveyor 5 can be moved in the opposite circular-arc direction.

A turning part 3c of movable conveyor 3 is connected to turning drive unit 3d, which may be, for example, a servomotor. Turning drive unit 3d communicates with a control unit (not shown) and is thereby operated. Thus, by the operation of turning drive unit 3d, supporting surface 3a is turned in free reciprocating horizontal motion along the circular-arc orbital path of stationary conveyor 5. In this embodiment, turning part 3c is connected to turning drive unit 3d with a belt 3e.

On supporting surface 3a of movable conveyor 3, an upper compartment 3' is defined over the distance from the feeding-in port 2 which is substantially equivalent to the outlet position of the above feeding-in conveyor 1 to the leading edge of conveyor 3 in the feeding direction. Meanwhile, on supporting surface 5a of the stationary conveyor 5, a lower compartment 5' is defined over the distance from the lower position of the leading edge of movable conveyor 3 in the feeding direction to the leading edge of stationary conveyor 5 in the feeding direction.

Furthermore, ahead of the leading edge of movable conveyor 3 in the feeding direction, a guide plate 4 is positioned in such a manner as to be oppositely separated from and transverse to the leading edge of movable conveyor 3. The lower portion 4a of guide plate is inclined downwardly with respect to the feeding direction of stationary conveyor 5. Further, the lower end 5b is close to supporting surface 5a of stationary conveyor 5. With this arrangement, a turning passage 4' is defined over the distance from the leading edge of upper compartment 3' on movable conveyor 3 to the end of lower compartment 5' on stationary conveyor 5. Thus, upon the reciprocating turning motion of movable conveyor 3 accompanied by the above-described turning drive unit 3d, the guide plate 4 is horizontally turned in a free reciprocating motion along the circular-arc orbital path of stationary conveyor 5 since guide plate 4 is connected to movable conveyor 3.

Also, in the vicinity of the inlet of feeding in conveyor 1, (that is, outlet Al of the cigarette fabricating machine A), a detector 8a is provided for detecting the height of built-up cigarettes T in the vicinity of outlet Al. The detector 8a communicates with the above control unit, and controls feeding-in conveyor and cigarette fabricating machine A through the control unit.

In this embodiment, four detectors 8a are vertical disposed over horizontal part la of feeding-in conveyor 1 at different positions. When the uppermost detector 8a detects the height of built-up cigarettes T and actuates the ON state, the operations of feeding-in conveyor 1 and cigarette fabricating machine A are both stopped. When the second detector 8a actuates the ON state, feeding-in conveyor 1 is switched into a high speed mode. When the third detector 8a actuates the ON state, feeding-in conveyor 1 is switched into a low speed mode. Furthermore, when the lowermost detector 8a actuates the ON state, feeding-in conveyor 1 is started at a low speed, and when the detector actuates the OFF state, the operation of feeding-in conveyor 1 is stopped.

In the vicinity of feeding-in port 2, a detector 8b is provided for detecting the height of cigarettes T fed from feeding-in conveyor 1 and built-up near feeding-in port 2. Detector 8b communicates with the above control unit and controls feeding operation of movable conveyor 3 through the control unit.

In this embodiment, when detector 8b detects the height of the built-up cigarettes T to be a specified height, the feeding operation of movable conveyor 3 is started. When the built-up height is greater than the specified height, the feeding speed of movable conveyor 3 is increased. When the built-up height is less than the specified height, the feeding operation of movable conveyor 3 is stopped.

In the vicinity of feeding-out port 6, a detector 8c is provided for detecting the height of the cigarettes T fed from stationary conveyor 5 and built-up in the vicinity of feeding-out port 6. The detector 8c communicates with the control unit and controls stationary conveyor 5 and feeding-out conveyor 7 through the control unit.

In this embodiment, when detector 8c detects the height of the built-up cigarettes T to be a specified height, the feeding operation of stationary conveyor 3 is started. When the built-up height is greater than the specified height, the feeding operation of stationary conveyor 5 is stopped. When the built-up height is less than the specified height, the feeding operation of feeding-out conveyor 7 is stopped.

Furthermore, in the vicinity of the outlet of feeding-out conveyor 7 (that is, inlet B1 of packaging machine B), a detector 8d is provided or detecting the height of the cigarettes T built-up in the vicinity of inlet B1. Detector 8d communicates with the control unit and controls feeding-out conveyor 7 and packaging machine B.

In this embodiment, when detector 8d detects the height of the build-up cigarettes T to be a specified height, the feeding operation of feeding-out conveyor 7 is started. When the built-up height is more than the specified height, the feeding operation of feeding-out conveyor 7 is stopped. When the built-up height is less than the specified height, the operation of packaging machine B is stopped.

This control unit detects the feeding-in amount of the cigarettes T from the feeding-in port 2 to movable conveyor 3 on the basis of the operational speed of cigarette fabricating machine A. The control unit also detects the feeding-out amount of the cigarettes T from stationary conveyor 5 to the feeding-out port 6 on the basis of the operational speed of packaging machine B. Thus, according to the difference between the feeding-in amount and the feeding-out amount, when the feeding-in amount is greater than the feeding-out amount, movable conveyor 3 is driven in the same direction as the feeding direction, and when the feeding-out amount is greater than the feeding-in amount, movable conveyor 3 is driven in the opposite direction to the feeding direction.

The control unit may correctively control the above driven direction of movable conveyor 3. For this purpose, a detector 8 e communicating with the control unit is provided in the vicinity of the leading edge of upper compartment 3' on movable conveyor 3. This detector 8e detects the height of the cigarettes T built-up in the vicinity of the leading edge of upper compartment 3'. Thus, movable conveyor 3 may be correctively controlled in its driven direction.

A plurality of detectors 8e are vertically disposed at different positions. When the upper detector 8e detects the built-up height of the cigarettes T, the driven direction of movable conveyor 3 is switched to the feeding direction. When only the lower detector 8e detects the built-up height of the cigarettes T, the driven direction of movable conveyor 3 is switched to the direction opposite to the feeding direction.

The function of the feeding/storing apparatus for rods according to the present invention is described as follows.

First, a group of cigarettes T which were fed from inlet A1 of cigarette fabricating machine A is fed to feeding-in port 2 by feeding-in conveyor 1, and thus built-up in upper compartment 3' which is defined on movable conveyor 3. Then, the group of cigarettes T is fed in the circular-arc direction by movable conveyor 3, by being pushed from the leading edge of upper compartment 3' to the guide plate 4, and is fed to the end of lower compartment 5', which is defined on stationary conveyor 5, through turning passage 4'. Then, the group of cigarettes T is fed in the circular-arc direction by stationary conveyor 5, and is pushed from the front end of lower compartment 5' to guide 6a.

At this time, the group of cigarettes T is fed in such a manner that the filter side portions T1 are directed to the outer peripheral sides of movable conveyor 3 and stationary conveyor 5, and have the same circular-arc shape. Accordingly, the cigarettes T are built-up radially around the circular-arc center of movable conveyor 3 and stationary conveyor 5. Consequently, the filter side portions T1 and the opposed cigarette-leading edge portions T2 horizontally abut each other, respectively, and thus the cigarettes T are firmly built-up.

Accordingly, the cigarette-leading edge portions T2 never roll or slip due to vibrations during the feeding operations of movable conveyor 3 and stationary conveyor 5.

When the feeding-in amount of the cigarettes T from feeding-in port 2 to movable conveyor 3 is more than the feeding-out amount from stationary conveyor 5 to feeding-out port 6, the movable conveyor 3 and guide plate 4 are turned in the direction of movable conveyor 3 according to the difference between the feeding-in amount and the feeding-out amount. This increases the capacities of upper compartment 3' and lower compartment 5', thereby making it possible to store the excessive cigarettes T.

Conversely, when the feeding-in amount of the cigarettes T from the feeding-in port 2 to movable conveyor 3 is less than feeding-out amount from stationary conveyor 5 to feeding-out port 6, movable conveyor 3 and guide plate 4 are turned in the direction opposite to the feeding direction of movable conveyor 3 according to the difference between the feeding-in amount and the feeding-out amount. This decreases the capacities of upper compartment 3' and lower compartment 5', thereby feeding-out and supplying the stored cigarettes T.

Accordingly, even when the stored amount is increased and decreased by the movable conveyor 3 according to the difference between the feeding-in amount and the feeding-out amount, the spacing between the cigarette fabricating machine A and the packaging machine B is not changed.

After that, the group of cigarettes T is fed to the feeding-out port 6, and is fed from the feeding-out port 6 to inlet B1 of packaging machine B by feeding-out conveyor 7.

Figure 4:
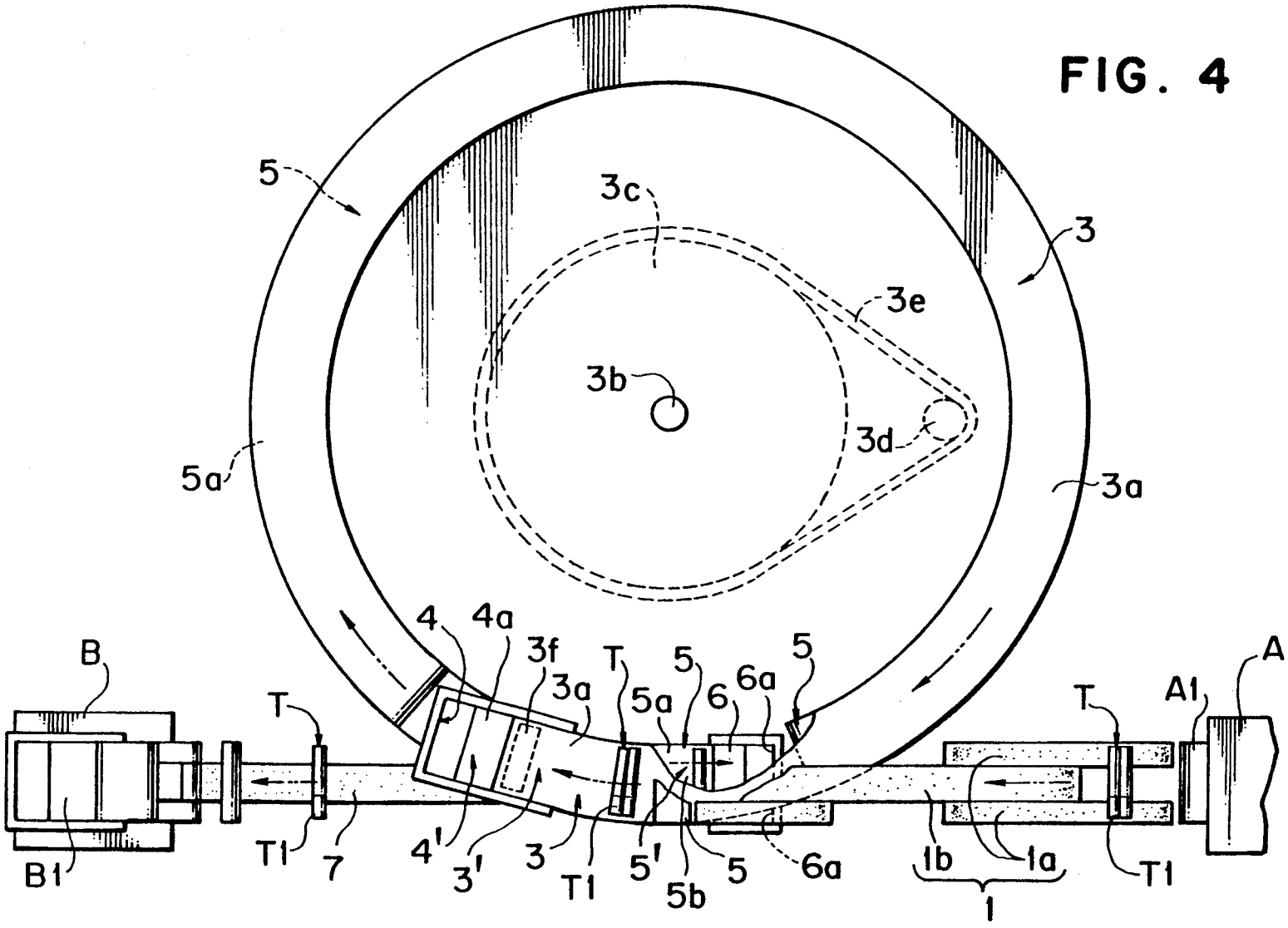
FIG. 4 is a plan view, partially broken away, of a feeding/storing apparatus for rods according to a second embodiment of the present invention.
Figure 5:
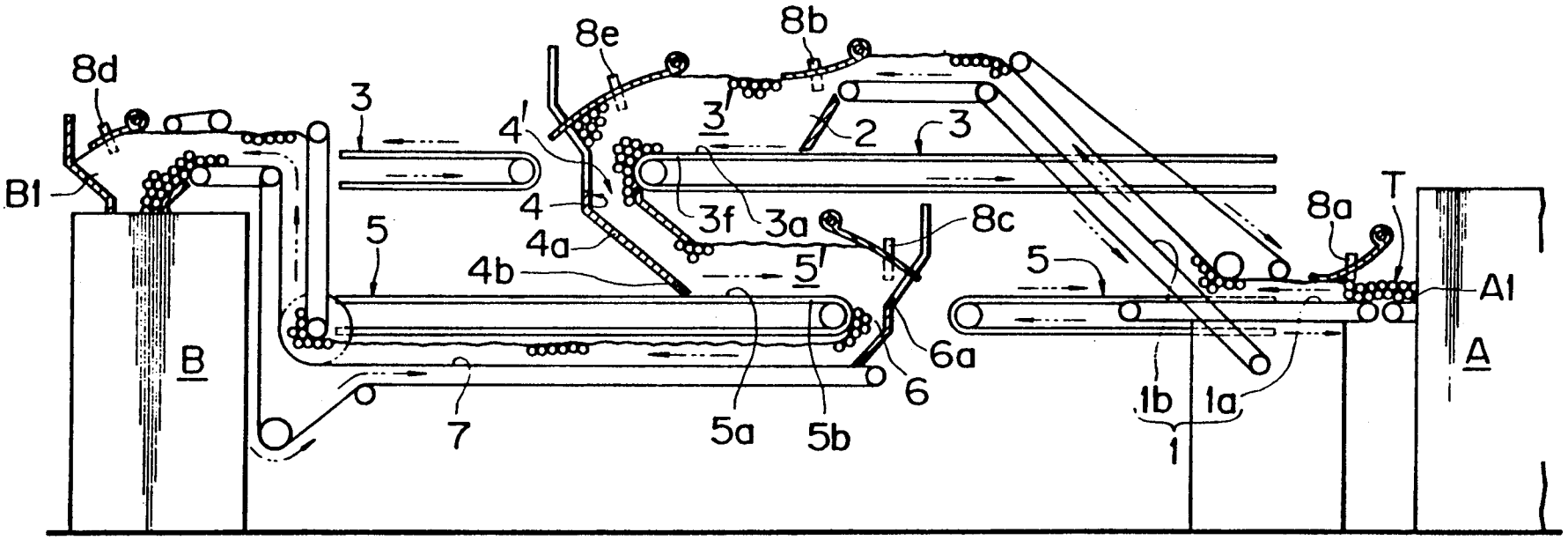
FIG. 5 is a vertical sectional front view of the embodiment of FIG. 4.

FIGS. 4 and 5 illustrate another embodiment of the present invention. In this embodiment, a linear part 3f is positioned at the leading edge of movable conveyor 3 in the feeding direction in such a manner as to be transverse to guide plate 4 at right angles. With this arrangement, the group of cigarettes T fed by movable conveyor 3 having the circular-arc shape, is linearly fed for a suitable length in the horizontal direction, and is then horizontally pushed to guide plate 4. Also, the lower portion 4a of guide plate 4 is inclined downwardly with respect to the feeding direction of stationary conveyor 5 along the lower side of linear part 3f for the horizontal length of linear part 3f. Furthermore, a linear part 5b is positioned at the leading edge of stationary conveyor 5 in the feeding direction in such a manner as to be transverse to guide 6a at right angles. Thus, the group of cigarettes T fed by circular-arc shaped stationary conveyor 5 is linearly fed for a suitable length in the horizontal direction, and is then horizontally pushed to guide 6a.

Also, among the cigarettes T which are fed from feeding-in port 2 and built-up on upper compartment 3', sector-shaped gaps are respectively formed in the feeding direction. However, when the cigarettes T are then linearly fed for a suitable length in the horizontal direction at linear part 3f, and are horizontally pushed from the leading edge of upper compartment 3' to guide plate 4, the above-described gaps are compressed so as to be parallel to each other, and thus both ends of cigarettes T pressedly-contact each other in the feeding direction under the same conditions. Therefore, cigarettes T are linearly press-fed to guide plate 4.

Furthermore, among the cigarettes T which are fed through turning passage 4' and built-up in upper compartment 3', sector-shaped gaps are respectively formed in the feeding direction. However, when the cigarettes T are then linearly fed for the suitable length in the horizontal direction at linear part 3d, and are horizontally pushed from the leading edge of lower compartment 5' to guide 6a, the above-described gaps are compressed so as to be parallel to each other, and thus both ends of cigarettes T pressedly-contact each other in the feeding direction under the same conditions. Therefore, the cigarettes T are linearly press-fed to guide 6a.

Incidentally, in the above embodiments, a feeding-in conveyor 1 is provided over the distance from outlet Al of cigarette fabricating machine A, as the pre-processing machine, to feeding-in port 2 provided over movable conveyor 3, and feeding-out conveyor 7 is provided over the distance from feeding-out port 6 to inlet B1 of packaging machine B. However, the present invention is not limited thereto. For example, outlet Al of the cigarette fabricating machine A may directly communicate with feeding-in port 2 and feeding-out port 6 may directly communicate with inlet B1 of packaging machine B without interposing feeding-in conveyor 1 and feeding-out conveyor 7. Also, pre-processing machine A and post-processing machine B are not limited to the cigarette fabricating machine A and the packaging machine B, but may include the other respective machines.

Also, in the drawings, feeding-in conveyor 1 and feeding-out conveyor 7 are linearly arranged in a plan view; however, they are not limited thereto, but may be arranged in other shapes, such as a "dog-legged" shape depending on the space provided for the arrangement.

Furthermore, the cigarettes T are fed in such a manner that the filter side portions T1 are directed to the outer peripheral sides of movable conveyor 3 and stationary conveyor 5; however, the cigarettes T may be fed in such manner that the filter side portions T1 are directed to the inner peripheral sides of movable conveyor 3 and stationary conveyor 5. Also, the rods of the present invention may include filterless cigarettes or cylindrical filter plugs.

The present invention as constructed as described above has the following advantages:

1. The circular-arc shaped movable conveyor is horizontally turned along the circular-arc orbital path of the stationary conveyor according to the difference between the feeding-in amount from the feeding-in port to the movable conveyor and the feeding-out amount from the stationary conveyor to the feeding-out port. This makes it possible to increase and decrease the capacities of the upper compartment defined on the movable conveyor and the lower compartment defined on the stationary conveyor. Thus, the imbalance between the demand of the post-processing machine and the supply from the pre-processing machine can be adjusted. Also, the rods fed from the feeding-in port can be fed to the feeding-out port while sequentially passing through the upper compartment and the lower compartment. Therefore, it is possible to first feed out the bars which were first stored while increasing the stored amount without significantly lengthening the movable conveyor and the stationary conveyor in the direction between a pre-processing machine and the post-processing machine.

Accordingly, as compared with the conventional apparatus, wherein the movable conveyor is linearly moved over the stationary conveyor for increasing the stored amount, even when the stored amount is further increased, the preprocessing machine is not significantly separated from the post-processing machine, thereby eliminating enlargement of the entire size of these apparatus. Furthermore, when the rods are cigarettes, as compared with the conventional apparatus wherein the cigarettes first fed-in are last feedout, there is no fear of storing the first stored cigarettes for a long time, thereby preventing the cigarettes from being degraded.

2. The rods fed on the movable conveyor from the feeding-in port are fed in the circular-arc direction by the movable conveyor, and are then linearly fed at the linear part so as to be transverse to the guide plate at right angles. This eliminates sector-shaped gaps between the rods. Thus, the rods are arranged in parallel with each other, and are horizontally pushed from the leading edge of the upper compartment to the guide plate. Consequently, the rods can be pushed from the movable conveyor to the stationary conveyor while keeping the alignment.

Accordingly, when the group of rods built-up by the movable conveyor is horizontally pushed to the guide plate, the rods never slip in the axial direction and are thus prevented from being disordered. Thus, it is possible to linearly press-feed the group of rods at high efficiency, and further to prevent the irregularity of the attitude in the rods by eliminating the need for a disorder preventing plate.

3. The rods are fed in the circular-arc direction by the stationary conveyor, and are then linearly fed to feeding-out port at the linear part. This eliminates the sector-shaped gaps between the rods. Thus, the rods are arranged in parallel with each other, and are pushed from the leading edge of the lower compartment to the feeding-out port. Consequently, the rods can be pushed from the stationary conveyor to the feeding-out port while keeping the alignment.

Accordingly, when the group of rods built-up by the stationary conveyor is horizontally pushed to the feeding-out port, the rods never slip in the axial direction and are thus prevented from being disordered. Thus, it is possible to linearly press-feed the group of rods at high efficiency, and further to prevent the irregularity of the attitude in the rods by eliminating the need of erecting a disorder preventive plate.

4. The cigarettes are fed in such a manner that the filter side portions are directed to the outer peripheral sides of the circular-arc shaped movable and stationary conveyors. Accordingly, the cigarettes are radially stacked around the circular-arc center of the movable and stationary conveyors, respectively. Thus, when the rods are filter-cigarettes, the filter-cigarettes can be built-up in such a manner that the filter side portions and the opposed leading edge side portions horizontally abut each other, respectively.

Accordingly, as compared with the conventional apparatus wherein the cigarettes are stacked in multi-levels on the linear conveyor, there are no gaps between the leading edge side portions of the built-up cigarettes in the horizontal direction. Consequently, the leading edges of the cigarettes never slip due to the vibrations caused during the feeding operation, thereby preventing degradation of the quality, such as damage of the cigarettes or loosing cut tobacco.

The present disclosure relates to subject matter contained in Japanese Patent Application No. 4-39600 (filed Feb. 26, 1992), which is herein incorporated by reference in its entirety.

Although the invention has been described with reference to particular means, materials and embodiments, it is to be understood that the invention is not limited to the particulars disclosed and extends to all equivalents within the scope of the claims.

What is claimed is:

1. A feeding/storing apparatus for rod-shaped articles comprising:

a stationary conveyor communicating with a feeding-out port, a horizontally movable conveyor being provided over said stationary conveyor and communicating with a feeding-in port, said stationary conveyor and said movable conveyor being in parallel and spaced relation with each other;

a turning passage movable with said movable conveyor, said turning passage being formed over the distance from the leading edge of an upper compartment defined on said movable conveyor to the end of a lower compartment defined on said stationary conveyor;

whereby the capacities of said upper compartment and said lower compartment are increased and decreased by horizontal movement of said movable conveyor according to the difference between a feeding-in amount from said feeding-in port to said movable conveyor and a feeding-out amount from said stationary conveyor to said feeding-out port; and wherein said movable conveyor and said stationary conveyor are respectively formed in circular-arc shapes having the same curvature; the center of the circular-arc of said stationary conveyor being arranged directly under the center of the circular-arc of said movable conveyor; said movable conveyor being horizontally turnable; and supporting surfaces of said movable conveyor and said stationary conveyor being moved in the opposite circular-arc directions to each other.

2. A feeding/storing apparatus for rod-shaped articles according to claim 1, wherein a guide plate is positioned separately from the leading edge of said movable conveyor in the feeding direction; a linear part being positioned at a leading edge of said movable conveyor in the feeding direction in such a manner as to be transverse to said guide plate at right angles; and a lower portion of said guide plate being inclined downwardly with respect to the feeding direction of said stationary conveyor by the horizontal length of said linear part.

3. A feeding/storing apparatus for rod-shaped articles according to claim 2, wherein a linear part is positioned at a leading edge of said stationary conveyor in the feeding direction so as to be directed toward said feeding-out port.

4. A feeding/storing apparatus for rod-shaped articles according to claim wherein said rod-shaped articles comprise filter cigarettes, said cigarettes being fed in such a manner that the filter side portions thereof are directed to outer peripheral sides of said movable conveyor and said stationary conveyor.

5. A feeding/storing apparatus for rod-shaped articles comprising:

a stationary conveyor, a horizontally movable conveyor being provided over said stationary conveyor, said stationary conveyor and said movable conveyor being in parallel and spaced relation with each other;

a turning passage being movable with said movable conveyor, said turning passage communicating with an upper compartment defined on said movable conveyor and a lower compartment defined on said stationary conveyor;

whereby the capacities of said upper compartment and said lower compartment are increased and decreased by horizontal movement of said movable conveyor according to the difference between a feeding-in amount to said movable conveyor and a feeding-out amount from said stationary conveyor; and wherein said movable conveyor and said stationary conveyor are respectively formed in circular-arc shapes having the same curvature; the center of the circular-arc of said stationary conveyor being arranged directly under the center of the circular-arc of said movable conveyor; said movable conveyor being horizontally turnable; and supporting surfaces of said movable conveyor and said stationary conveyor being moved in the opposite circular-arc directions to each other.

6. A feeding/storing apparatus for rod-shaped articles according to claim 5, wherein a guide plate is positioned adjacent a leading edge of said movable conveyor in the feeding direction; a linear part being positioned at a leading edge of said movable conveyor in the feeding direction in such a manner as to be transverse to said guide plate at right angles; and a lower portion of said guide plate being inclined downwardly with respect to the feeding direction of said stationary conveyor by the horizontal length of said linear part.

7. A feeding/storing apparatus for rod-shaped articles according to claim 6, wherein a linear part is positioned at a leading edge of said stationary conveyor in the feeding direction.

8. A feeding/storing apparatus for rod-shaped articles according to claim 5, wherein said rod-shaped articles comprise filter cigarettes, said cigarettes being fed in such a manner that the filter side portions thereof are directed to outer peripheral sides of said movable conveyor and said stationary conveyor.

9. A method for feeding/storing rod-shaped articles, comprising the steps of:

providing a stationary conveyor for communicating with a feeding-out port which is provided under a horizontally movable conveyor and communicating with a feeding-in port;

providing a turning passage movable with said movable conveyor, said turning passage being formed over the distance from the leading edge of an upper compartment defined on said movable conveyor to the end of a lower compartment defined on said stationary conveyor;

changing the capacities of said upper compartment and said lower compartment by horizontally moving said movable conveyor according to the difference between a feeding-in amount from said feeding-in port to said movable conveyor and a feeding-out amount from said stationary conveyor to said feeding-out port;

forming said movable conveyor and said stationary conveyor are respectively in circular-arc shapes having the same curvature, the center of the circular-arc of said stationary conveyor being arranged directly under the center of the circular-arc of said movable conveyor; and horizontally turning said movable conveyor, thereby moving the supporting surfaces of said movable conveyor and said stationary conveyor in the opposite circular-arc directions to each other.

10. A method for feeding/storing rod-shaped articles according to claim 9, wherein said rod-shaped articles comprise filter cigarettes, and feeding said cigarettes in such a manner that the filter side portions thereof are directed to outer peripheral sides of said movable conveyor and said stationary conveyor.

* * * * *

UNITED STATES PATENT AND TRADEMARK OFFICE

CERTIFICATE OF CORRECTION

PATENT NO. : 5,275,271

DATED : January 4, 1994

INVENTOR(S) : I. Endo, et. al.

It is certified that error appears in the above-indentified patent and that said Letters Patent is hereby corrected as shown below:

Title page, item [56], under U.S. Patent Documents, change "4,869,115" to -- 3,869,115--.

Signed and Sealed this

Twenty-sixth Day of November 1996

*Attest:*

Bruce Lehman

BRUCE LEHMAN

*Attesting Officer*

*Commissioner of Patents and Trademarks*